US005586401A

United States Patent [19]

Sheehan et al.

[11] Patent Number: 5,586,401

[45] Date of Patent: Dec. 24, 1996

[54] ART WORK DISPLAY APPARATUS

[76] Inventors: Gary T. Sheehan, 7 Frazer Ave., Malvern, Pa. 19355; Paul G. Landry, 9 N. Cedar Hollow Rd., Paoli, Pa. 19301

[21] Appl. No.: 331,806

[22] Filed: Oct. 31, 1994

[51] Int. Cl.[6] ..... G09F 1/12

[52] U.S. Cl. ..... 40/737; 40/757

[58] Field of Search ..... 40/152.1, 152, 40/661, 160, 156, 159.1

[56] References Cited

U.S. PATENT DOCUMENTS

| | | | |
|---|---|---|---|
| D. 288,630 | 3/1987 | Haugen | D6/300 |
| D. 294,088 | 10/1988 | Lofredo | D6/300 |
| 1,778,636 | 10/1930 | Herbert | 40/152.1 |
| 1,809,786 | 6/1931 | LeJeune | 40/152 |
| 3,707,053 | 12/1972 | Itano | 40/158 |
| 4,258,488 | 3/1981 | Schienbein | 40/152 |
| 4,290,216 | 9/1981 | Gale | 40/152.1 |
| 4,290,530 | 9/1981 | Wooster . | |
| 4,310,976 | 1/1982 | Wilten | 40/152.1 |
| 5,050,324 | 9/1991 | Casull | 40/152 |
| 5,148,618 | 9/1992 | Brewster | 40/661 X |

FOREIGN PATENT DOCUMENTS

| | | | |
|---|---|---|---|
| 551270 | 3/1923 | France | 40/152.1 |
| 2575380 | 7/1986 | France | 40/152 |
| 2196845 | 5/1988 | United Kingdom | 40/152 |

OTHER PUBLICATIONS

Catalog—Exposures, Summer 1, 1992.

*Primary Examiner*—Joanne Silbermann
*Attorney, Agent, or Firm*—Jack D. Puffer

[57] ABSTRACT

A display apparatus for displaying a phonograph album cover or the like is described which is composed of a front and a rear cover plate, both of transparent material for supporting the album cover therebetween. The cover plates are attached to each other by pairs of upper and lower fasteners of transparent material. The upper fasteners being placed outside of the area occupied by the album cover and the lower fasteners being placed below the lower edge of the album cover and spaced horizontally apart a distance less than the horizontal dimension of the lower edge of the album cover, whereby the album cover is supported on the lower fasteners.

5 Claims, 2 Drawing Sheets

ART WORK DISPLAY APPARATUS

BACKGROUND OF THE INVENTION

This invention relates in general to apparatus for displaying an art work and in particular, to displaying an art work in a manner such that both the front and back of the work can be observed without removing the work from the apparatus.

This invention is particularly well adapted for the display of phonograph album covers. Phonograph albums are typically manufactured in the form of a vinyl disc. While these albums are rapidly being replaced by compact discs and tape cassettes, they often are decorated with art work suitable for display as a decorative item in a home or business. Such albums are also the subject of serious collections, both for the music on the discs but also for the art work of the cover independent of the music.

Prior art apparatus for displaying such album covers have provided a frame having a slot into which the album is inserted. Such devices usually obscure the back of the cover which often contains art as important as the front. In addition, these frames often obscure the edges of the cover as part of the cover retaining means. Other devices in the prior art provide a box-like structure into which the cover can be inserted. However, these devices usually contain a complex closing mechanism which makes them relatively expensive to manufacture. In yet other display devices, the art work is simply pressed between two plates and the art work is held in the frame by the friction between the art work and the front and rear plates. In the case of vinyl albums, it is not desirable to apply such pressure on the vinyl disc since this can damage the disc and severely affect the sound produced when the album is played.

SUMMARY OF THE INVENTION

The present invention overcomes the disadvantages of the prior art by enclosing the art work between front and rear plates, held together by transparent fasteners. However, unlike the prior art devices of similar design, the art work is not pressed between the plates. The bottom fasteners holding the front and rear plates together are spaced apart horizontally a distance less than the horizontal dimension of the bottom edge of the art work. The art work is allowed to rest on the bottom fasteners without being squeezed between the plates. The top fasteners are spaced apart a horizontal distance greater that the horizontal dimension of the top edge of the art work. The upper surfaces of the lower fasteners and the inner surfaces of the upper fasteners facing the central portion of the cover plates define the display area for the art work. Thus the bottom edge of the work is placed above the fasteners and none of the work is obscured by the fasteners. Likewise, because the top fasteners are placed outside the upper edge of the work, the entire work is seen. In addition, the frame need not be taken completely apart in order to change the display. By merely loosening the top fastener, the art work may be removed and a new work inserted. In order to provide an easy means for hanging the apparatus, a simple cord or wire can be fastened to the rear of the frame using the top fasteners and the display hung as a picture on the wall with the addition of only the hanging device using the existing fasteners for attachment. Finally, the simple construction of the apparatus of this invention comprising two plates and the plate fasteners allows it to manufactured at a lower cost and sold at a relatively low price.

DETAILED DESCRIPTION OF THE PREFERRED EMBODIMENT

Figure 1:
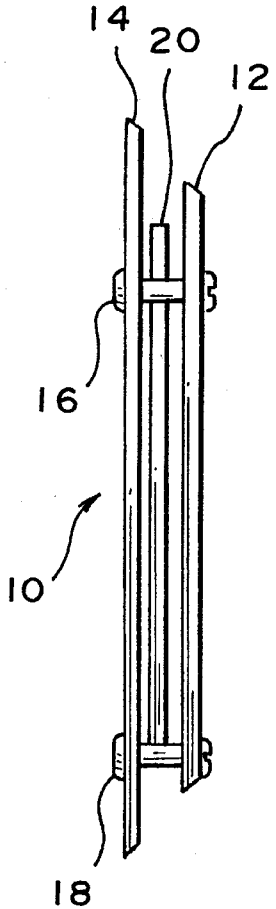
FIG. 1 is a side view of the assembled invention

Referring now to FIG. 1, there is shown at 10, a side view of the assembled apparatus of the invention. There is provided a front plate 12 of transparent material such as acrylic or plexiglass. A rear plate 14, which can be made larger than the front plate 12 for aesthetic reasons, may be made of the same material as the front plate or from a different material which my be opaque or even provide a reflective surface. Between the plates 12 and 14 there is placed the art work for display. This may be a phonograph album or other art work. The front and rear plates are attached together by a pair of top fasteners, 16 and a similar pair of bottom fasteners 18. The bottom fasteners 18 are placed apart a horizontal distance greater than the horizontal dimension of the bottom edge of the art work. This feature allows the art work displayed to rest on the two bottom fasteners for support. The upper fasteners 16 are placed apart a distance greater than the horizontal dimension of the art work in order that the fasteners mat be positioned outside of the edge of the art work and thus, not obscure any of the art work from the viewer.

Figure 2:
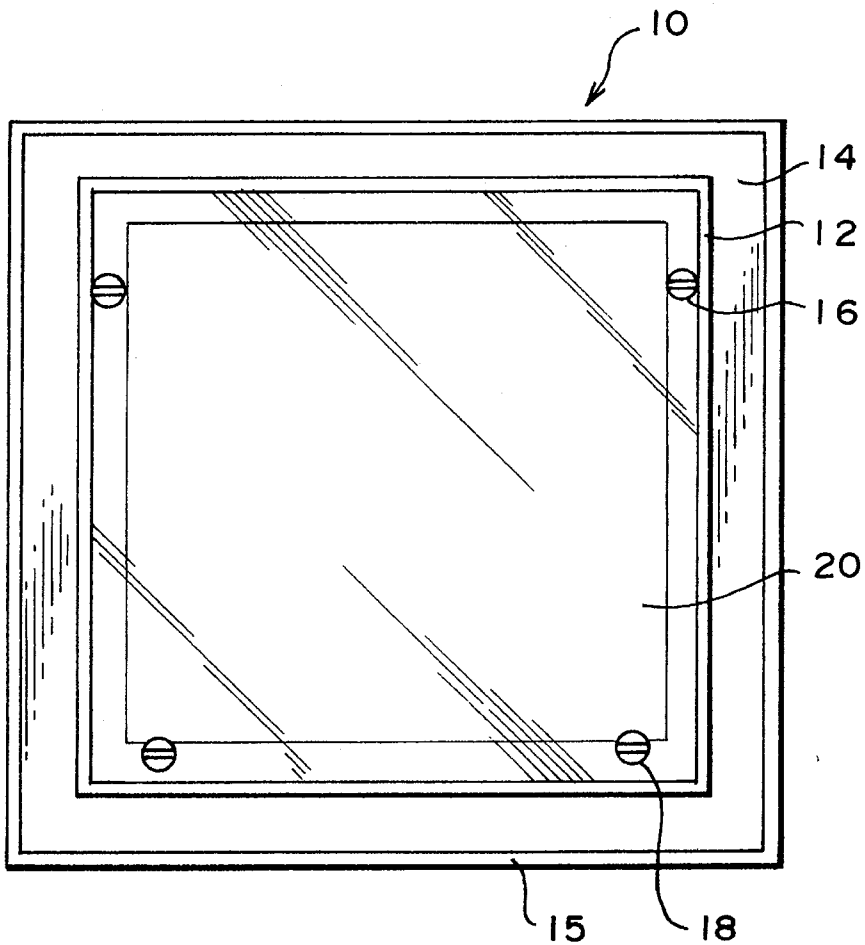
FIG. 2 is a front view of the article of FIG. 1.

FIG. 2 is a front view of the assembled apparatus of the invention. This Figure more clearly illustrates the positioning of the top and bottom fasteners. As can be seen, the bottom fasteners 18 support the art work 12. Since the art work is supported on the bottom fasteners, the pressure exerted by tightening the fasteners together need to be only enough to make a snug assembly and does not need to be so tight as to hold the art work by frictional force as is the case in some prior art devices. In addition when the display art is resting on the lower fasteners, the art work is automatically aligned parallel with the edges of the front and rear plates.

Figure 3:
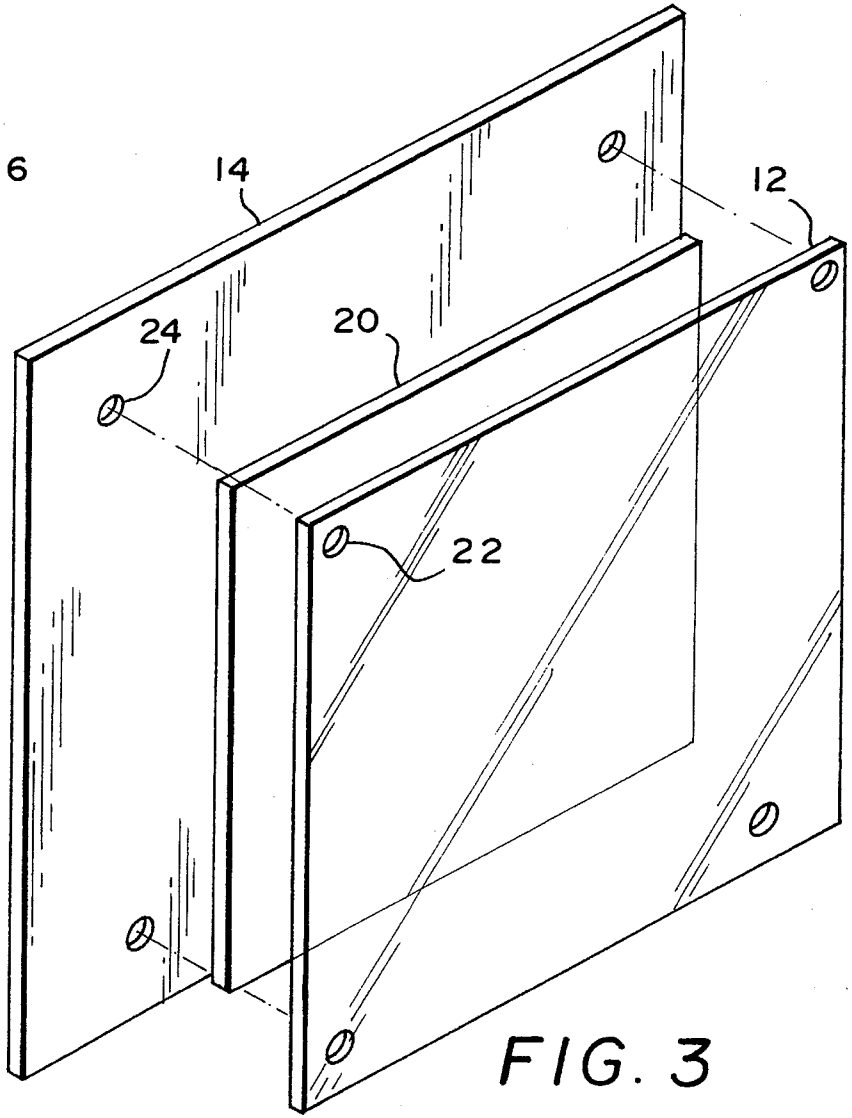
FIG. 3 is an expanded, isometric view of the front and rear plates and the art work in position for assembly.

FIG. 3 is an expanded isometric view of the front plate 12, the art work 20 and the rear plate 14 in their relative positions prior to installation of the fasteners 16 and 18.

Figure 4:
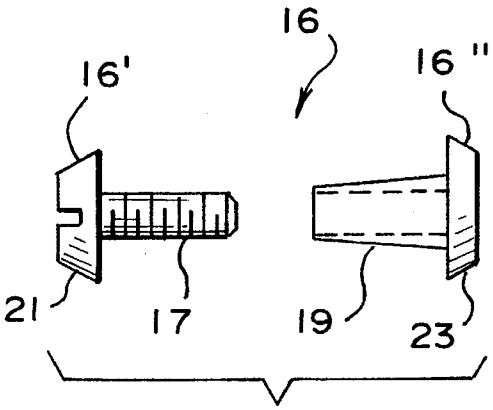
FIG. 4 is an enlarged view of the fasteners of the invention.

FIG. 4 illustrates a typical fastener used in assembling the apparatus of the invention. The fasteners are preferably made of a transparent material substantially the same as the material of the front and rear plates 12 and 14 respectively. Shown is one of the upper fasteners 16 separated into its two component parts. The male portion, 16' is a screw-like member having a head portion 21 and a shank portion 17 of conventional design with threads on its external diameter. The female portion of the fastener 16" has a head portion 23 and a shank portion 19. The shank portion is provided with internal threads (not shown) to engage the external threads of the male member 16". The outer diameter of the female member is slightly tapered so that when it is inserted in the hole in the rear plate it is held securely by the taper and no adhesive is required in the assembly. The fact that no adhesives are required in the assembly insures a clean appearing assembly as well as an assembly that is easily taken apart in order to change the display art. The fasteners 16 and 18 are of substantially the same design. The length of the fasteners may be adjusted to accommodate the thickness of the art work to be displayed. This adjustable feature is accomplished by providing threads along the entire length of the fastener parts, thus, the length of the fastener is determined by the amount that the male and female portions are engaged. For example, some phonograph album covers are relatively thin for accommodating a single record. However, some phonograph record album covers a re made to accommodate two, three or more records in a single cover. To display one of these albums, it is only necessary to adjust the fasteners 16 and 18 to the required length to make a thicker assembly. Obviously, if the thickness of the display art exceeds the longest length obtainable by the standard fastener, longer fasteners may be used.

Figure 5:
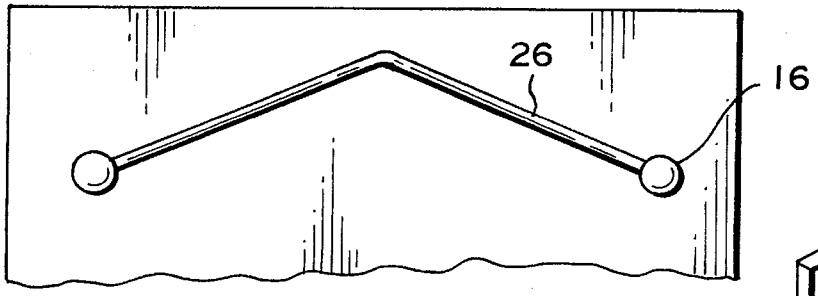
FIG. 5 is a partial view of the rear plate with the hanging device attached.
Figure 6:
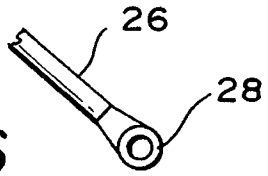
FIG. 6 is a detail of the end attachment of the hanging device of FIG. 5.

Referring now to FIGS. 5 and 6, there is shown a structure for an attachment to the assembly in order that it may be hung on a wall or other vertical surface. A cord or wire 26 of appropriate length is provided with end pieces 28 which have a thin expanded end having an opening therein of a size to accept the shank 19 of the female portion of one of the upper fasteners 16. When the apparatus is assembled the upper fastener 16 is inserted in the opening of the end pieces 28 of the cord 26 attaching the hanging cord 26 to the back of the rear plate 14.

Thus there is disclosed herein, a simple apparatus for displaying an art work such as a phonograph album in which the art work is supported on a pair of bottom fasteners which attach a front plate to a rear plate with the art work placed between the plates. The assembly can be modified to accommodate art works of varying thickness by selecting an appropriate length for the fastener. The fasteners, both at the upper and lower edges of the assembly, serve dual purposes. The lower fasteners support and align the art work to be displayed and the upper fasteners provide a means for hanging the assembly on a vertical surface. The apparatus is of simple a design which allows the display of the front and rear surfaces of the art work and can be manufactured at a low cost and sold at a low price.

What is claimed is:

1. Apparatus for displaying an article, said apparatus comprising:

a front cover plate of transparent material;

a rear cover plate of at least the same size as the front cover plate; upper fastening means for fastening said front cover plate to said rear cover plate, said upper fastening means comprising at lease two fasteners spaced apart on a horizontal line, said fasteners having inner surfaces facing the central portion of said cover plates along said horizontal line;

lower fastening means for fastening said front cover plate to said rear cover plate, said lower fastening means comprising at least two fasteners, said lower fasteners having an upper surface facing the top edges of said cover plates, and spaced apart on a horizontal line a distance less than the horizontal distance between said upper fasteners and being positioned to provide vertical support for the article between the front and rear cover plates, the length of said upper and lower fastening means being adjustable according to the thickness of the article; and support means attached to the rear surface of the rear cover plate by said upper fasteners.

2. The apparatus according to claim 1 wherein the rear cover plate is of transparent material.

3. Display apparatus comprising:

an article for display, said article having upper and lower edges and left and right lateral edges;

a front cover plate of transparent material;

a rear cover plate;

at least two upper fastening means separated on a horizontal line for fastening said front cover plate to said rear cover plate a specified distance apart, one of said upper fastening means abutting the left lateral edge of said article and another of said fastening means abutting the right lateral edge of said article for restraining lateral movement of said article; and at least two lower fastening means separated on a horizontal line for fastening said front cover plate to said rear cover plate a specified distance apart, said lower fastening means being separated on a horizontal line by a lesser distance than the horizontal distance between said upper fastening means, said lower edge of said article resting on said lower fastening means for vertical support and for limiting downward movement of said article.

4. The apparatus according to claim 3 and further comprising apparatus support means attached to the rear surface of said rear cover plate by said upper fasteners.

5. The apparatus according to claim 4 wherein the upper and lower fasteners are of transparent material.

* * * * *